United States Patent [19]

Herrmann

[11] 4,344,745

[45] Aug. 17, 1982

[54] SELF-SEALING GEAR PUMP WITH SEALING PRESSURE DIVIDER

[75] Inventor: Gert Herrmann, Solingen, Fed. Rep. of Germany

[73] Assignee: Pierburg Luftfahrtgeräte Union GmbH, Neuss, Fed. Rep. of Germany

[21] Appl. No.: 77,137

[22] Filed: Sep. 19, 1979

[30] Foreign Application Priority Data

Oct. 26, 1978 [DE] Fed. Rep. of Germany ..... 2846547

[51] Int. Cl.[3] ..... F04C 2/18; F04C 15/00

[52] U.S. Cl. ..... 418/132

[58] Field of Search ..... 418/131-133, 418/135, 180

[56] References Cited

U.S. PATENT DOCUMENTS

| | | | |
|---|---|---|---|
| 2,665,641 | 1/1954 | Lauck | 418/131 |
| 3,558,247 | 1/1971 | Gaertner | 418/131 |
| 4,090,820 | 5/1978 | Teruyama | 418/132 |

*Primary Examiner*—John J. Vrablik

*Attorney, Agent, or Firm*—Toren, McGeady & Stanger

[57] ABSTRACT

A self-sealing gear pump has seals formed between the end faces of the gear wheels and adjacent faces of a casing of the pump by thrust plates interposed between the end faces of gear wheels and the casing. The thrust plates have cavities formed behind them and are pressed against the end faces by the pumped fluid under pressure being admitted to the cavities. Each cavity is connected to both the high pressure side of the pump and the low pressure side of the pump by ports or nozzles, the flow section of the nozzle leading to the high pressure side being larger than that of the nozzle leading to the low pressure side. The surface area of each thrust plate exposed to its cavity is greater than its surface area exposed to the high pressure side of the pump and each cavity and the fluid connections to it are constructed as a hydraulic potentiometer which causes the pressure in the cavity and hence the sealing pressure of the plate against the gear wheels to be adjustable.

15 Claims, 14 Drawing Figures

FIG. 4
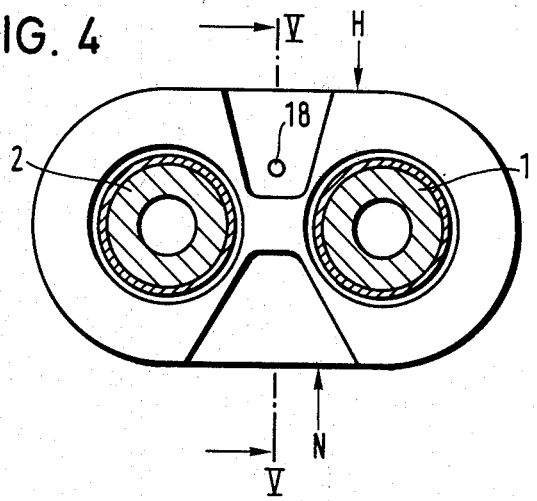
FIG. 5
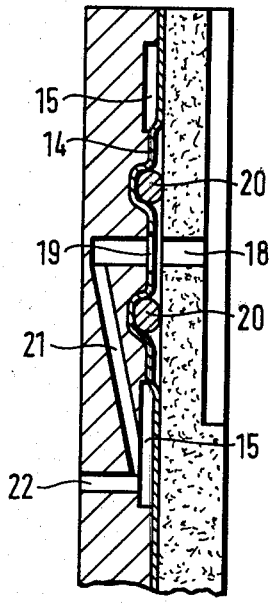
FIG. 6
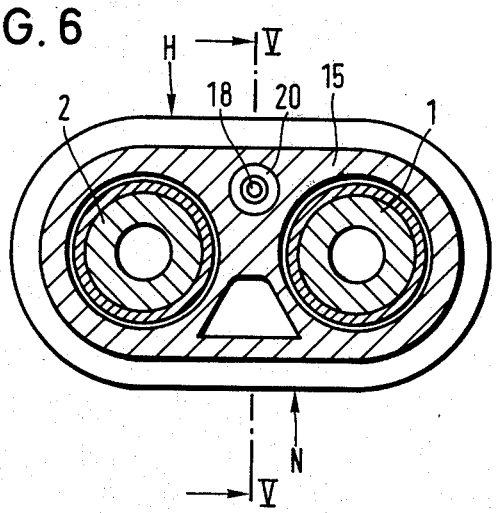
FIG. 7
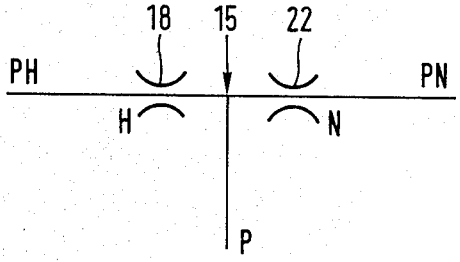
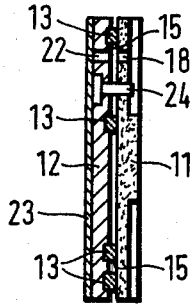
FIG. 8

SELF-SEALING GEAR PUMP WITH SEALING PRESSURE DIVIDER

This invention relates to self-sealing gear pumps having a seal formed between at least one of the two end faces of the gear wheels by a thrust plate interposed between the end face and a side member of a casing which encloses the gear wheels, the thrust plate bearing against the end face and having formed behind it a cavity which extends between the high pressure and low pressure sides of the pump and is of an annular configuration, the cavity being connected through a nozzle or port to the high pressure side of the pump.

End face sealing members, which also form plain bearing bushes which support the gear wheels and are thrust against the end faces with a force proportional to the discharge pressure of the pump, are usually used for sealing the gear wheel end faces of gear pumps. The area of the surface on which the discharge pressure acts on the side of the sealing member remote from the gear wheel end faces is made greater in the region disposed at the discharge side of the pump than in the region at the inlet side of the pump to ensure that the contact force diminishes from the discharge side to the inlet side of the pump. A specific frictional torque, which is intrinsically desirable, therefore acts on the sealing members. At high rotational speeds or in the presence of a large pressure difference between the high pressure or delivery side of the pump and the low pressure or inlet side of the pump, the frictional torque which also of course acts on the gear wheels, can become so large that a high braking effect occurs due to friction in the gap between the seal member and gear wheel end faces and of course also in the plain bearing. Extensive lubrication of the gap is therefore necessary. Conventionally, such lubrication is effected by the pumped fluid which is commonly oil.

As a result of the frictional torque it is possible to use only plain bearings when employing the aforementioned seal members, which also function as bearing bushes and since such bearings must also be lubricated by the pumped fluid under pressure, a part of the pump delivery, which increases with increasing output, is required to lubricate the pump itself. Since efficiency deteriorates with increase of rotational speed and/or increasing back pressure, a stage of development has been reached at which any further improvement of output for a given size of pump does not appear possible despite the adoption of the highest degree of precision.

The above-mentioned disadvantage is mainly due to the fact that the function of the bearing and of the seal is combined in a single component, that is the plain bearing member. A constructional improvement of the one function of the component cannot therefore remain without effect, frequently detrimental, on the other parameters.

It has also therefore been attempted to provide separate components for sealing and for the bearings of the gear wheels. Thrust plates, which are flexible to the pump pressure, are provided in a gear pump described in German Patent specification No. 12 93 600, which is similar to the pump initially described. The cavity behind the thrust plate is divided into pressure zones or pressure cells which are sealed relative to each other and each is connected by means of a short bore in the thrust plate directly to the tooth gap between the gear wheels and this gap passes momentarily by the bores as the gear wheels rotate. The purpose of this is to achieve pressure equalization corresponding to the gradient which occurs between the high-pressure and low-pressure sides of the pump and thus to adapt the pressure acting from the cavity pressure cells to the instantaneous pressure which prevails in the tooth gaps. However, owing to the need for providing individual separated cavity cells and their pressure supply means through separate ports, which are trouble prone due to possible blockage, this form of construction is not only complex but increasing pressure results in the faces of the flexible thrust plates nearest to the gear wheel end faces assuming a more or less distinct corrugated shape, conditioned by the cell walls.

German Patent Specification No. 12 93 600 also discloses a gear pump of the initially described kind in which the casing cavities behind the thrust plates which are also flexible, in the region between the gear wheels merge with each other so that in their entirety they are approximately the shape of a figure eight. Each of the annular cavities behind the thrust plate is connected to the pump delivery side through a port situated in the region of the tooth meshing zone and in operation of the pump the cavities are therefore filled with fluid under discharge pressure. One disadvantage of this seal is due to the fact that at the places at which the gear wheels are subjected to low pressure, the thrust plates are urged with excessive force against the gear wheel end faces and yield irregularly because of their flexibility. Thus a braking effect on the gear wheels occurs which increases with the pressure difference between the delivery side and the inlet side of the pump and this causes heavy wear, particularly at high rotational speeds, and severely restricts the efficiency and the service life of the pump.

The sealing effect increases with increasing rotational speed or increasing pressure difference between the inlet and delivery sides in all gear pumps which are self sealing, i.e. pumps which are sealed by the action of pressure of the pumped fluid. As a result, the intrinsically rapid rise in the rate of fluid leakage, which increases relatively more than the flow of pumped fluid with an increasing pressure difference and reduces the pump output, is slowed down, but at the same time the braking effect of the sealing means and therefore the wear is substantially increased. Hitherto, this dilemma was resolved by weakening the self-sealing effect and by increasing the pump dimensions, to the extent that the rate of leakage fluid flow, which increases because of the deteriorating sealing effect, was compensated by additional pump output. However, this results in an increase in the size and manufacturing cost of the pump. In many cases, for example in the case of fuel pumps in aircraft, it is not readily possible to tolerate an increase in the weight of such components.

Despite this fact, further development for the purpose of improved efficiency or increased output met an apparently insurmountable barrier despite the most costly and refined designs. Owing to the disadvantages enumerated for pumps of the kind described initially, these have not been even able to achieve acceptance against those in which the bearing and sealing functions are combined in a single component. Therefore practically all heavy duty gear pumps in actual use are provided with plain bearings which must be lubricated under the full pressure of the pumped fluid in a manner which is exceptionally detrimental to the pump efficiency.

It is an object of the invention to provide a self-sealing gear pump of the kind initially described in which the sealing effect between the thrust plate or plates and the gearwheel end face or faces in the lower and middle speed range, i.e. in the normal working range, is so efficient that leakage quantities are insignificant in relation to the pumped quantities of fluid and overdimensioning of the pump is therefore not necessary.

In existing pumps of this kind the braking action and therefore the rate of wear increases with increasing speed. From a specific speed range upwards, the rate of wear becomes so large, even in short period operation, that operational reliability of the pump cannot be ensured. It is therefore also an object of the invention to construct a pump of the kind described so that the braking action and therefore the rate of wear in the upper speed range do not increase substantially. Preferred embodiments of pumps in accordance with the invention also simplify production of the cavity, which is responsible for the self-sealing action of the pump and also cause the force acting on the rear of the thrust plate to be adjusted automatically so that it is adapted to the force which is produced on the high-pressure and low-pressure sides of the pump and acts on the face of the thrust plate adjacent the end faces of the gear wheel.

According to this invention, in a pump of the kind initially described, the thrust plate is resistant to bending, the surface area of the thrust plate exposed to the pressure within the cavity is greater than the surface area of the thrust plate acted upon by the pressure of the fluid being pumped on the high pressure side of the pump and the cavity and the fluid connections to it are constructed as a pressure divider so that the pressure of the fluid in the cavity is adjustable.

Since the thrust plate is resistant to bending, different portions thereof do not have a different sealing effect from each other on the gap at the gear wheel end face but instead the thrust plate functions as an intrinsically rigid piston which is movable in its entirety and is subjected to hydraulic pressure. Furthermore, the surface area on the cavity side of the thrust plate, which functions in the manner of a piston, is exposed to a pressure, which is the so called potentiometric high pressure, which is lower than the pressure acting on the other side of the thrust plate adjacent the gear wheel end face. However, since the surface area of the thrust plate subjected to the cavity pressure is greater than the surface area exposed to the pressure of the pumped fluid on the high-pressure side of the pump, it is possible for the hydraulic pressing force applied to the end face by the thrust plate acting in the manner of a piston and defined by the product of the pressure and surface area to be adapted to the pump pressure acting on the front face of the thrust plate. This can be achieved by presetting of the pressure divider.

One important advantage of the pump in accordance with the invention is due to the fact that at low rotational speeds the pressure divider which controls the pressure of the fluid supplied to the cavity, produces an internal cavity pressure which is greater in relation to the pressure of the high pressure side of the pump than at high and maximum rotational speeds. This in turn produces the effect that, as is desired, the sealing action of the thrust plates in the most common working range, for example, at low and medium rotational speeds, is sufficiently powerful and the leakage rate in relation to the pumping rate is not significant. The pump in accordance with the invention can therefore generally be dimensioned as though no leakage losses have to be compensated. At high speeds and maximum speeds, outside the usual operating range, such leakage losses are increased due to the presence of the pressure divider but the excessive rise in the rate of wear which had to be tolerated in the upper speed range of conventional pumps is avoided.

The pressure divider can be constructed or arranged so that it does not develop any appreciable action in the intended working speed range of the pump, that is to say it does not appreciably reduce the cavity pressure in this speed range, and only becomes effective to reduce the cavity pressure at higher speeds by ensuring, while tolerating an increasing leakage rate, that the braking effect of the thrust plate and therefore wear does not continue to rise at high rotational speeds. The pump in accordance with the invention can therefore be dimensioned so as to be accurately adapted for the intended operating range without any significant increase of wear at rotational speeds which substantially exceed the nominal range. Reduced hydraulic efficiency, i.e. a less favourable ratio of leakage rate to pumping rate, must be tolerated at high rotational speeds but this is readily acceptable since there are only exceptional circumstances in which the pump is required to operate above its nominal speed range.

In contrast to self-sealing gear pumps at present used, the gear wheels of the pump in accordance with the invention can be supported in rolling bearings which are lubricated by the leakage amounts of the pumped fluid. Such rolling bearings do not call for lubrication from the high pressure side of the pump which would substantially reduce the efficiency of the pump but they nevertheless require quantities of lubricant which increase with increasing rotational speed. This requirement can be met by the pump in accordance with the invention since the amount of leakage fluid increases substantially with increasing rotational speed because of the reduction of the pressure in the cavity below the discharge pressure of the pump in the higher speed range. The pump therefore enables the gear wheels to operate in rolling bearings in any speed range without the need for any external lubrication or without the need for directly obtaining pumped fluid from the high pressure side of the pump in addition to the leakage fluid.

Advantageously, in order to regulate the pressure in the cavity, the cavity is connected to the pump inlet or the low pressure side of the pump through a second nozzle or port which extends through an adjacent casing side, the second nozzle or port having a flow cross-section which is smaller than that of the first nozzle which connects the cavity to the high pressure side of the pump. The casing may be a backing plate. Calibration of the nozzles therefore enables the force on the thrust plate to be hydraulically adjusted in accordance with requirements in each individual case that is it permits adjustment of the function of the nozzles as a pressure divider.

According to another embodiment of the invention the nozzles can be made variable, i.e. adjustable in dependence on the pressure on the high pressure side of the pump and/or the temperature if a valve which opens progressively with increase of pressure and/or fall in temperature, is provided at a flow outlet of the second nozzle. A pressure-dependent valve is advantageously obtained by an arrangement in which the flow outlet of the second nozzle is disposed on a face of the casing side containing the second nozzle, the outlet being disposed opposite to the thrust plate, and the valve being formed by a spring plate which covers the outlet and acts as a pressure-dependent valve. Conveniently the spring plate is constructed as a baffle plate which resiliently yields to the pump pressure. Since the flow cross-section of the second nozzle increases with increasing pressure on the high pressure side of the pump, it follows that the pressure in the cavity which is between the high pressure and the external or low pressure, and therefore the force on the thrust plate corresponding to the cavity pressure will increase at a rate which is lower than that at which the high pressure itself increases.

If such self-regulation of the flow cross-section of the second nozzle will not fully meet requirements in any particular case, it is possible to obtain a further improvement of the pressure-dependent valve by providing a bore which extends through the thrust plate and accommodates a piston, one end of which bears on the spring plate and the other end of which is exposed to the high pressure side of the pump. The piston preferably bears on the baffle plate region of the spring plate. By defining the high pressure influenced surface area of the end of the piston, it is possible for each desired flow cross-section of the second nozzle to be adjusted in dependence on the magnitude of the high pressure.

The above-described nozzle arrangement for producing the contact force of the thrust plate, that is the pressure divider, can also be regulated in dependence on the temperature of the pumped fluid. To this end, according to a further embodiment of the invention, the flow outlet of the second nozzle which is disposed opposite to the thrust plate is covered by a bimetal strip acting as a temperature-sensitive valve. Advantageously the bimetallic strip is arranged so that it closes the second nozzle increasingly as the viscosity of the pumped fluid diminishes and therefore generally as its temperature increases. If the second nozzle has a valve, which is pressure responsive as well as temperature responsive, it is possible in a further embodiment of the invention for the low pressure side outlet of the second nozzle to be covered by a bimetallic spring plate which forms such a valve.

As already stated, the area of the cavity formed at the rear of the thrust plate has to be greater than the high pressure influence surface area on the sealing side of the thrust plate. According to general rules applied to gear pumps it is assumed that the high pressure influenced part of the gear wheel end faces amounts to only approximately one third to a maximum of one half of the total surface area of the end faces. The cavity area at the rear of the thrust plates exposed to the fluid pressure must be adjusted so that the product of internal pressure in the cavity and the thrust plate surface area subjected to this pressure is at least equal to the product of the pressure at the high pressure side of the pump and the high pressure influenced surface area so that the force applied over a pressure range of the pumped fluid (mean high pressure) to the face of the thrust plate adjacent the gear wheels is approximately equal to or less than the force applied from the cavity at the rear of the thrust plate.

It is also advantageous if the portion of the surface area of the cavity, which is disposed at the low pressure side of the pump and is subjected to the low pressure, is substantially smaller than the portion of the cavity surface area disposed at the high-pressure side of the pump. This ensures that each area behind the thrust plate is subjected to a force which corresponds approximately to the pressure applied at the same time by the gear wheel end faces to the front of the thrust plate. This causes the thrust plate to act in the manner of a piston and obviates or reduces canting of the thrust plate due to asymmetrically distributed forces. Accordingly, the cavity should have an asymmetric area distribution in relation to the area of the gear wheel end faces.

Advantageously, the cavity comprises an indentation which extends over the surface of the thrust plate at the high pressure side of the pump into the region between the gear wheels and a contiguous strip portion of the cavity, the area of which is small relative to that of the indentation, which extends along the end face of the gear wheels at the low pressure side of the pump and around the gear wheels up to the indentation. The force acting from the cavity on the low pressure region of the rear of the thrust plate will then be smaller than that acting on the high pressure region, so that the forces acting from both sides, point by point, on the thrust plate have substantially the same morphological configuration. To achieve the desired sealing action it is necessary, by selecting the area and shape of the internal surfaces of the cavity and the flow areas of the nozzle arrangement which potentiometrically biasses the latter, to ensure that the force acting from the cavity in the direction of the gear wheel end faces is greater than the reaction force which acts from the high-pressure side of the pump.

According to a further embodiment of the invention it is advantageous if successive sector elements of the same circumferential angle of the cavity have a continuous or progressively diminishing surface area, which is to be subjected to pressure, from the high-pressure side to the low-pressure side of the pump along the rims of the gear wheels so that the previously mentioned adaptation of force characteristics along the gear rims can be adapted as accurately as possible on both sides of the thrust plate to actual conditions. In principle it can therefore be said that it is advantageous if the strip of the cavity extending on both sides from the indentation formed on the high pressure side of the pump between the gear wheels becomes progressively narrower over its length from the high pressure to the low pressure region.

In principle and apart from the previously mentioned size ratios, the cavity formed between the thrust plate and the casing member, such as a backing plate, can be shaped and sealed in any desired manner. For example, the cavity can be sealed with respect to the gear wheels or the gear rim end faces thereof in the radially outward and inward directions by means of O-rings or cord rings disposed in grooves, which may be formed in the backing plate. In this connection, it is advantageous if the high pressure side of the pump communicates directly via the first nozzle or port with the cavity which is sealed by means of O-rings or cord rings.

However, it has been found particularly advantageous if the cavity is formed as a multiple contiguous recess which covers the gear rims on the end face and is sealed by a diaphragm, for example of rubber, which is inserted between the thrust plate and the casing member. According to a further improvement it is advantageous, more particularly in the last-mentioned case, if the high pressure side of the pump and the cavity communicate with each other through a duct which adjoins the first nozzle and extends into the adjacent side member of the casing through an aperture in the diaphragm, the aperture being surrounded by a seal. This ensures that the diaphragm always remains in its intended position and cannot flutter or close the cavity which it seals at the rear of the thrust plate.

Depending on requirements of individual cases, a thrust plate which may advantageously be constructed of bronze or of metal with a film applied thereto by electrolytic means or metal spraying, can be provided at only one or at both ends of the gear wheels. In gear pumps with externally meshing gear wheels it is usually convenient to provide thrust plates to seal both end faces of the gear wheels but in gear pumps having two gear wheels which mesh internally it may be sufficient to seal only one end face of the gear wheels by means of a thrust plate while the other end face of the gear wheels is pressed against a face on a rigid casing member.

Further details of the invention will be explained by reference to embodiments illustrated in the accompanying diagrammatic drawings in which:

FIG. 4 is a section along the line IV—IV of FIG. 1 of a pump incorporating a cavity formed by means of a diaphragm;

FIG. 5 is a section along the line V—V of FIG. 4;

FIG. 6 is section along the line VI—VI of FIG. 1 along the plane of the diaphragm;

FIG. 7 shows a hydraulic circuit of the pump and the mode of operation of nozzles of the pump;

FIG. 8 is a section along the line VIII—VIII of FIG. 2 of a pump incorporating a spring plate associated with a second nozzle of the pump;

Figure 9:
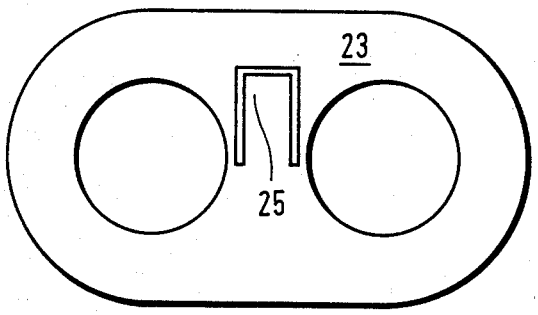
Figure 10:
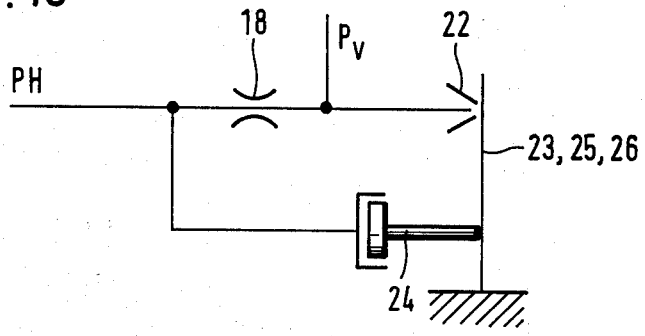
Figure 11:
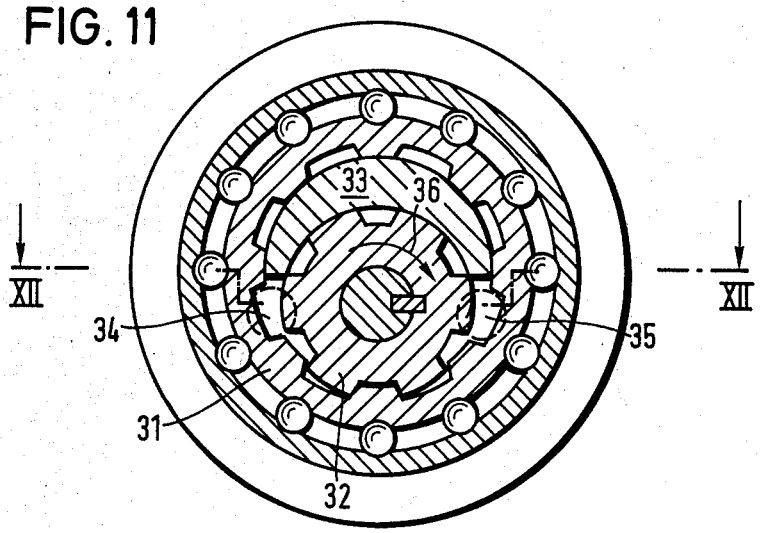
Figure 12:
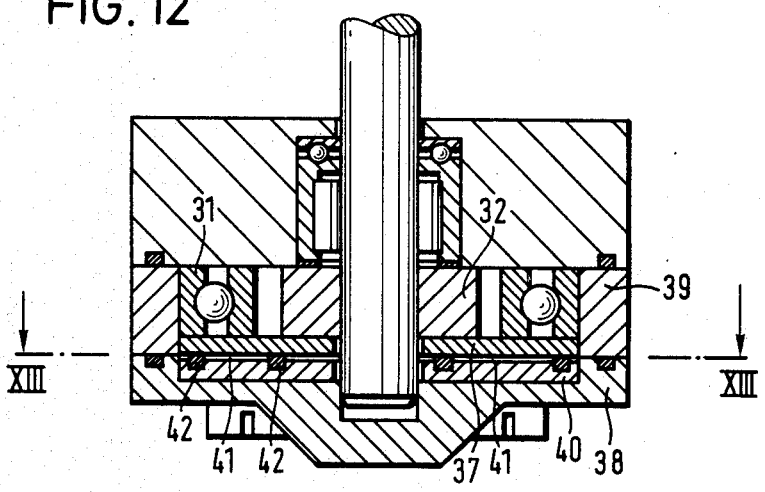

FIGS. 9 and 9*a* show the form of a spring plate of FIG. 8 in section along the line IX—IX;

FIG. 10 shows a hydraulic circuit and the mode of operation obtained with a pump having a variable second nozzle;

FIG. 11 is a section through another example of the pump with internal meshing;

FIG. 12 is a section along the line XII—XII of FIG. 11; and

Figure 13:
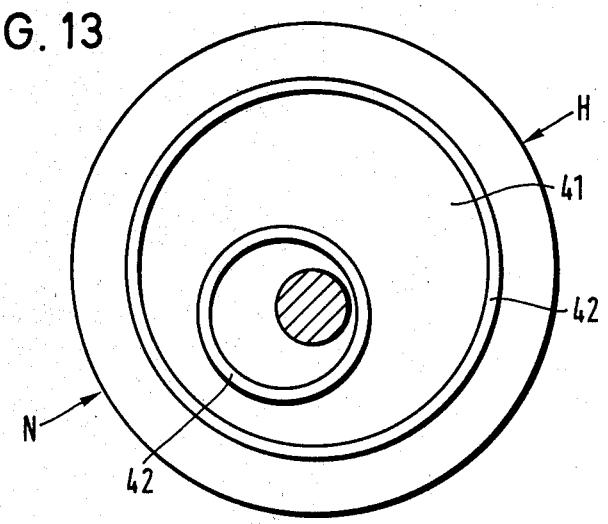

FIG. 13 is a section along the line XIII—XIII of FIG. 12.

FIGS. 1 to 10 refer to embodiments of gear pumps with gear wheels 1 and 2 which mesh externally. A driving gear wheel 1 is driven by a shaft 4 provided with splines 3, and meshes with a driven gear wheel 2 in the region of the centre line 5 of the appropriate section. The gear wheels 1 and 2 are supported in rolling bearings 6, disposed in casing side members 8, which adjoin a middle casing member 7 and the bearings are in contact with the pumped fluid. Plate springs 9, which urge the gear wheels 1 and 2 against thrust bearings 10, are disposed in one casing side member 8. The prestress of the plate springs 9 results in a defined axial location of the gearwheels 1 and 2 even if the casing of the pump expands due to temperature changes or differences. Axial clearance cannot therefore occur.

Bending-resistant, thin thrust plates 11, which in their entirety are hydraulically pressed against the gear wheel end faces in order to achieve the desired end seals, are inserted between the end faces of the gear wheels 1 or 2 and the middle casing member 7 at one end of the gear wheels, and the casing side members 8 at the other end of the gear wheels. Furthermore, seals are disposed between the thrust plates 11 and the adjacent casing side members 8—usually on separate backing plates 12. The seals can be formed as round cord rings or O-rings 13 (see also FIGS. 2 and 3) or as diaphragms 14 (see also FIGS. 5 and 6). The seals and, where provided, recesses in the backing plates 12 (see FIG. 5), form a cavity 15 on the side of the thrust plate 11 which is remote from the gear wheel end faces, that is between the thrust plate 11 and the adjacent backing plate 12.

The surface area F of the cavity 15 on the rear of the thrust plate 11 is usually formed of two or more contiguous parts and can be differently shaped, depending on the design principle. Advantageously, on the surface area of the thrust plate 11 disposed at the high pressure side H of the pump, the cavity 15 is provided with an indentation 16 (FIG. 2) which extends into the region between the gear wheels 1 and 2. Conveniently the cavity 15 extends as an integral or multiple contiguous strip 17 along the gear wheel end faces around the pair of gear wheels on both sides, starting from the indentation 16 and having a surface area which is relatively small with respect to that of the indentation 16. As already explained, the area of the cavity 15, including the indentation 16 on the high pressure side H, should be substantially greater than the area of the strip 17 on the low pressure side N.

On the high pressure side H, and more particularly at a central point of the indentation 16, the cavity 16 is provided with a port or nozzle 18 which extends through the thrust plate 11 to the high-pressure chamber of the pump. The cavity 15 in the embodiments of FIGS. 2 and 3, defined by the O-rings 13, usually communicates directly with the high-pressure pump chamber via the the nozzle 18. In contrast, an additional seal is generally required in the region of the nozzle 18 for the cavity 15 when this is sealed by a diaphragm 14 for example a rubber diaphragm. In the embodiment of FIGS. 5 and 6 the diaphragm 14 is also provided with an aperture 19, adjoining the nozzle 18. The aperture 19 is sealingly surrounded by an O-ring 20 which is clamped between the thrust plate 11 and the backing plate 12. Furthermore, a duct 21, which finally leads to the cavity 15, extends from the aperture 19 of the diaphragm 14 in axial alignment with the nozzle 18 which is provided in the thrust plate 11.

Figure 1:
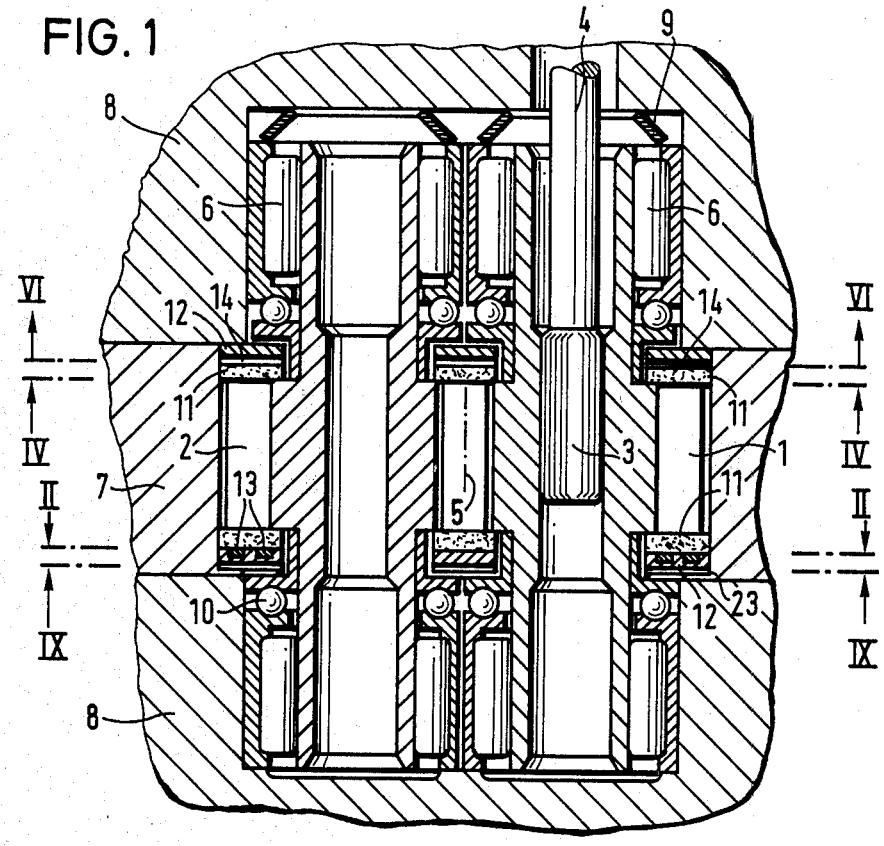
FIG. 1 is a section through one example of the gear pump along the gear wheel axes.
Figure 2:
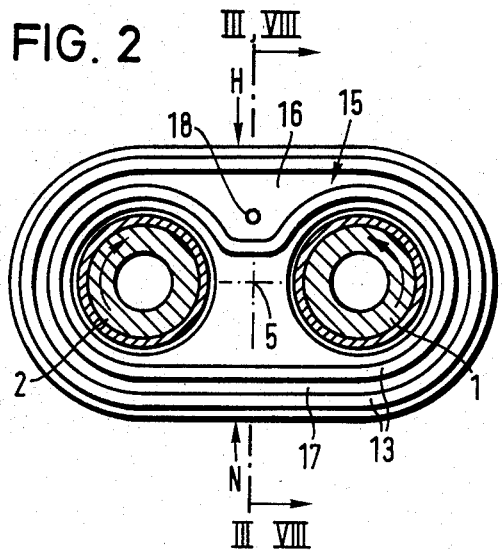
FIG. 2 is a section along the line II—II of FIG. 1 of a pump incorporating a cavity sealed by means of O-rings.
Figure 3:
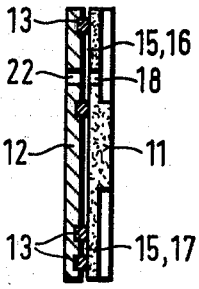
FIG. 3 is a section along the line III—III of FIG. 2.

The connection of the cavity 15, sealed by the diaphragm 14, to the high-pressure chamber of the pump in the embodiment of FIG. 5 generally calls for more precautions than the connection of the cavity 15 surrounded by the O-rings 13 as shown in FIG. 3. However, since the O-rings 13 in the embodiment of FIGS. 2 and 3 call for the provision of grooves of complicated shape, it follows that the production of a cavity 15 (FIG. 5) which is sealed by a diaphragm 14 is usually less expensive than the cavity 15 according to FIGS. 2 and 3 which is surrounded by the O-rings 13.

The cavity 15 communicates with the external fluid supply pressure or low pressure chamber of the pump (see FIGS. 3 and 5) via an additional second port or nozzle 22 which extends through the adjacent casing side member 8 or through the backing plate 12. The second nozzle 22 has a smaller flow cross-section than the first nozzle 18 which is provided between the cavity 15 and the high pressure chamber of the pump. Like the first nozzle it can be constructed in the form of a simple aperture or a short bore.

When a gear pump in accordance with any of these embodiments generates a head, the cavity 15 is filled with pressurized fluid via the first nozzle 18. Since the flow cross-section of the said first nozzle 18 is greater than that of the second nozzle 22 which extends to the low-pressure chamber of the pump, a mean pressure p will be generated in the cavity 15 in accordance with the pressure divider circuit symbolized in FIG. 7. This mean pressure is lower than the high-pressure PH on the high-pressure side H of the first nozzle and is greater than the low pressure PN on the low-pressure side N of the second nozzle 22. Since the multiple contiguous surface area F of the cavity 15 is greater than the surface area f, which is directly acted upon by the high pressure PH on the thrust plates 11, the force acting on the thrust plates 11 and corresponding to the product of pressure and pressurised surface area can be hydraulically adjusted by suitable design of the nozzles 18 and 22. For example, if an intensive sealing action is to be achieved while tolerating corresponding wear and braking action of the thrust plates 11 for a particular field of application of a pump, the flow cross-section ratio between the first nozzle 18 and the second nozzle 22 will be made greater than would be the case if the pump is to operate with a reduced sealing action, reduced wear and smaller braking action in an intended field of application.

As already explained initially, the pressure divider which pressurises the cavity 15 can also be adjusted or varied in dependence on the magnitude of the high pressure. To this end it is sufficient in principle to place a spring plate on the rear of the backing plate 12 situated opposite to the thrust plate 11, where the spring plates are adapted to close or cover with a predetermined spring force the rear exit of the second nozzle 22 which extends through the backing plate 12. For example, the spring plate can be designed so that it closes the rear exit of the second nozzle 22 practically completely if only a small delivery pressure is applied—i.e. if the pump delivers only a small amount of fluid at a low rotational speed. In this case, the full high pressure PH will be applied to the cavity 15 so that the thrust plate 11 is urged with a relatively strong force against the end face of the adjoining gear wheel. The quantity of leakage fluid will then be correspondingly low. However, if the delivery pressure and delivery rate increase, the spring plate 23 will be progressively lifted off the rear exit of the second nozzle 22 as a result of the increased force applied by the delivery pressure and the flow cross-section of the second nozzle 22 will be correspondingly increased. This means that the pressure $p_v$ prevailing in the cavity 15 becomes progressively lower in relation to the high pressure PH as this increases. The contact force applied by the thrust plate 11 to the gear wheel end faces simultaneously diminishes, giving rise to a reduced sealing action, lower braking effect and reduced wear. Conveniently the pressure divider is designed so that the above-mentioned reduction in the sealing action occurs only at the top limit of the normal operating range of the pump. In normal operation the pump will then have approximately unity hydraulic efficiency, i.e. a very low leakage rate and substantial leakage rates will occur only at exceptionally high rotational speeds as a result of the sealing action increasing progressively less than the pump pressure.

A piston 24, which is slidable in a bore extending through the thrust plate 11 and through the casing side member or the backing plate 12 is provided in the embodiment of FIG. 8. One end of the piston 24 abuts against the spring plate 23 or against a baffle plate 25, which is cut in U-configuration into the spring plate 23 and bears resiliently upon the rear exit of the second nozzle 22. The other end of the piston 24 is exposed to the high pressure side of the pump. More sensitive adjustment of the flow aperture associated with the second nozzle 22 and exposed by the spring plate in dependence on the magnitude of the high pressure is made possible by the action of the piston 24.

The hydraulic circuit and the mode of operation of the variable pressure divider, whose variability is assisted by the piston 24, is indicated in FIG. 10. One embodiment of the spring plate 23 itself with the recess region of the baffle plate 25 is shown diagrammatically in FIG. 9. As the high pressure PH increases in operation the piston 24 thrusts with an increasing force against the spring plate 23 which operates in one region simultaneously as the baffle plate 25 of the nozzle 22. At the exit of the nozzle 22 the gap between the spring plate 23 or the baffle plate 25 and the rear of the backing plate 12 (see also FIGS. 8 and 10) is therefore proportional to the high pressure PH. For small changes of the gap the varied pressure $p_v$ in the cavity 15 is approximately proportional to the gap and the spring characteristic is therefore proportional to the contact pressure.

Leakage losses in a gear pump can increase with increase of temperature because the leakage clearances become larger or remain constant and the viscosity of the pump fluid is reduced. This problem can be countered by positioning a bimetal strip in place of the spring plate 23 on the rear exit of the second nozzle 22 so that the flow cross-section thereof diminishes with increase of temperature. These features form a pressure divider which takes account of temperature changes and biasses the cavity 15 with pressurized fluid.

In a further embodiment, the pressure divider can also be constructed so that pressure changes on the high pressure side of the pump as well as temperature changes are allowed for in the potentiometer setting in the sense that the correspondingly changed pressure $p_v$ in the cavity 15 is increased as a result of a temperature increase and is reduced if the high pressure increases. In order to achieve this effect the low pressure side output of the second nozzle 22 can be covered by a bimetal spring plate as shown in FIG. 9*a*, the shape of which can correspond to that of the spring plate 23 according to FIG. 9, to function as a pressure and temperature dependent valve.

FIGS. 11 to 13 show different diagrammatic sectional views of a gear pump with two internally meshing gear wheels 31 and 32 of which the driving gear wheel 31 is disposed within the driven gear wheel 32. A crescent-shaped wall 33 is formed between the two gear wheels 31 and 32. Flow of fluid from the inlet 34 to the outlet 35 in the direction of the arrow 36 is ensured by enclosing the fluid in the tooth gaps of the driven gear wheel 32 and closed by the wall 33.

As regards the basic construction of the casing, the embodiment of FIGS. 11 to 13 is similar to that shown in FIGS. 1 to 10. An alternative arrangement however, is possible, and in principle this can also be used in the pump with externally meshing gear wheels, by a thrust plate 37, which is acted on at the rear by the potentiometric high pressure, being provided on only one end face of the gear wheels 31 and 32. In this embodiment the thrust plate 37 is clamped between a casing cover 38 and a middle casing member 39. The cavity 41, which is to be acted upon by the potentiometric high pressure, is constructed in the form of a multiple contiguous surface in the space between the thrust plate 37 and the adjoining casing cover 38 or a backing plate 40 recessed therein. The cavity 41 can be sealed by means of round cord or O-rings 42 or by means of a diaphragm but is supplied with pressure fluid via a nozzle system—variable where appropriate—in the same way as in the embodiment of FIGS. 1 to 10.

As regards sealing the gear wheel side surfaces there are therefore no substantial modifications in principle compared with the pump having gear wheels which mesh externally. In this case the shape of the multiple contiguous surface of the cavity 31 can be varied as desired between the thrust plate 37 and the backing plate 40. It is only necessary to observe the size ratio in relation to the surface area of the high pressure pump side, also the low-pressure/high-pressure surface area ratio within the cavity.

I claim:

1. In a self-sealing gear pump comprising a casing having internal wall surfaces, a pair of meshing gear wheels having two end faces, at least one of said end faces and one of said internal wall surfaces defining a gap and sealing means sealing said gap, said sealing means including a thrust plate interposed between said end face and said wall surface, means defining a cavity on the side of said thrust plate remote from said end face, said cavity extending between a high pressure and a low pressure side of said pump and being of an annular configuration, and first nozzle means communicating said cavity with said high pressure side of said pump to produce a fluid pressure in said cavity, the improvement wherein said thrust plate is resistant to bending and has a first surface area exposed to said fluid pressure within said cavity and a second surface area exposed to a pressure of said fluid on said high pressure side of said pump, said first surface area being greater than said second surface area and means operative together with said cavity and said first nozzle means to form pressure divider means whereby said fluid pressure in said cavity is adjustable in dependence upon operating parameters of said pump, said pressure divider means further comprising second nozzle means communicating said cavity to a low pressure side of said pump, said second nozzle means extending through said sealing means and having a flow cross-sectional area which is smaller than a flow cross-sectional area of said first nozzle means which communicates said cavity with said high pressure side of said pump, said sealing means further comprising a backing plate in said casing between one of said walls and said thrust plate, said second nozzle means being formed through said backing plate, and valve means associated with said second nozzle means, said valve means being responsive to at least one of an increase in pressure and a fall in temperature in said pump, said valve means being provided at a flow outlet of said second nozzle means, said flow outlet being disposed in a face of said backing plate opposite said thrust plate and said valve means including a spring plate covering said outlet and acting as pressure-responsive valve means.

2. A gear pump as claimed in claim 1, in which said spring plate includes baffle plate means which resiliently yields to said fluid pressure in said cavity.

3. A gear pump as claimed in claim 1, further comprising means defining a bore extending through said thrust plate and a piston slidably mounted in said bore, said piston having a first end and a second end, said first end bearing against said spring plate and said second end being exposed to said high pressure side of said pump.

4. A gear pump as claimed in claim 1, said spring plate further comprising a bimetal strip acting as temperature-responsive valve means and covering said flow outlet of said second nozzle means.

5. A gear pump as claimed in claim 1, in which said second nozzle means has an end at said low pressure side of said pump and said spring plate further comprising a bimetal spring plate covering said end, said bimetal spring plate acting as a pressure-responsive and temperature-responsive valve means.

6. A gear pump as claimed in claim 1, in which said cavity includes a first portion disposed at a low pressure side of said pump and a second portion disposed at a high pressure side of said pump, said first portion having a first effective area over which said fluid pressure in said cavity acts on said thrust plate and said second portion has a second effective area over which said fluid pressure in said cavity acts on said thrust plate, said first effective area being substantially smaller than said second effective area.

7. A gear pump as claimed in claim 6, in which said cavity includes means defining an indentation which extends over a portion of a surface of said thrust plate at said high pressure side of said pump into a zone between said gear wheels and said cavity further comprises a contiguous strip portion said contiguous strip portion having an area which is small relative to the area of said indentation and said contiguous strip portion extending along said end face of said gear wheels at a low pressure side of said pump and around said from one side of said indentation to the other side of said indentation.

8. A gear pump as claimed in claim 1, wherein said cavity includes a surface area which diminishes from said high pressure side of said pump to a low pressure side of said pump around said gear wheels.

9. A gear pump as claimed in claim 1, further comprising means peripherally sealing said cavity to said thrust plate, said sealing means being selected from the group consisting of O-rings and cord rings.

10. A gear pump as claimed in claim 9, further comprising means defining grooves in said backing plate, said O-rings or said cord rings being located in said grooves.

11. A gear pump as claimed in claim 9, wherein said first nozzle means communicates said cavity directly with said high pressure side of said pump.

12. A gear pump as claimed in claim 1, in which said cavity is formed as a multiple contiguous recess and further comprising diaphragm means sealing said recess, said diaphragm means being inserted between said thrust plate and said wall surface.

13. A gear pump as claimed in claim 12, further comprising a duct adjacent said first nozzle means, said duct communicating said high pressure side of said pump and said cavity and said duct extending into said wall of said casing through an aperture in said diaphragm, and seal means surrounding said aperture.

14. A gear pump as claimed in claim 1, in which said cavity and said thrust plate are provided at one only of said end faces of said gear wheels.

15. A gear pump as claimed in claim 1, further comprising rolling bearings supporting said gear wheels and means for conveying leakage quantities of fluid pumped by said pump to said bearings for lubrication thereof.

* * * * *